US005503368A

United States Patent [19]

Torres

[11] Patent Number: 5,503,368

[45] Date of Patent: Apr. 2, 1996

[54] SAFETY VEHICLE LIFT

[76] Inventor: Manuel Torres, 44601 17th St. East, Lancaster, Calif. 93535

[21] Appl. No.: 265,819

[22] Filed: Jun. 27, 1994

[51] Int. Cl.[6] ..... E02C 3/00

[52] U.S. Cl. ..... 254/88; 254/122; 254/126

[58] Field of Search ..... 254/88, 122, 126, 254/9 C, 9 B, 7 C, 7 B

[56] References Cited

U.S. PATENT DOCUMENTS

| | | | |
|---|---|---|---|
| 2,043,887 | 6/1936 | Dement | 254/9 C |
| 3,870,277 | 3/1975 | West | 254/88 |
| 4,461,456 | 7/1984 | Munna | 254/88 |

FOREIGN PATENT DOCUMENTS

| | | | |
|---|---|---|---|
| 1034571 | 6/1966 | United Kingdom | 254/88 |

*Primary Examiner*—Robert C. Watson
*Attorney, Agent, or Firm*—Richard L. Huff

[57] ABSTRACT

A safety vehicle lift comprising a unitary base of a flat rigid construction having parallel side edges and having parallel front and rear edges; a lifting assembly comprising a lower portion secured to the base between the side edges and adjacent to the rear edge, the lifting assembly also including a support platform positionable above the lower platform with crossed-linkage elements coupling the support platform and the lower platform in a scissor-like configuration, the linkage elements having pivotable ends secured to the lower portion and the support platform adjacent to the rearward end and axially shiftable ends secured for parallel movement within the lower portion and the support platform; drive mechanisms operatively coupled to the linkage mechanisms to effect the raising and lowering of the support platform while maintaining its parallelism with the lower portion; and a ramp having a lower end at the front edge of the base and a raised end at an intermediate portion of the base between the front end and the rear end adjacent to the end of the support plate remote from the rear end of the base for allowing the wheel of a car to be driven up the ramp and onto the support platform when in the lower orientation.

1 Claim, 4 Drawing Sheets

SAFETY VEHICLE LIFT

BACKGROUND OF THE INVENTION

1. Field of the Invention

The present invention relates to a new and improved safety vehicle lift and, more particularly, pertains to lifting vehicles to obviate the possibility of slippage while being serviced to thereby increase safety.

2. Description of the Prior Art

The use of jacks and hoists for cars, trucks and other vehicles is known in the prior art. More specifically, jacks and hoists for cars, trucks and other vehicles heretofore devised and utilized for the purpose of lifting the wheel of a car or truck so that service may be performed are known to consist basically of familiar, expected, and obvious structural configurations, notwithstanding the myriad of designs encompassed by the crowded prior art which has been developed for the fulfillment of countless objectives and requirements.

The prior art discloses a large number of jacks and hoists for cars, trucks and other vehicles. By way of example, U.S. Pat. No. 3,990,681 to McKeen discloses a pneumatic ramp for vehicle leveling.

U.S. Pat. No. 4,421,300 to Lundman discloses a vehicle ramp.

U.S. Pat. No. 4,886,243 to Trumball discloses an hydraulic jack ramp.

U.S. Pat. No. 5,000,423 to Snickers discloses a small vehicle lift.

Lastly, U.S. Pat. No. 5,118,081 to Edelman discloses a vehicular ramp apparatus.

In this respect, the safety vehicle lift according to the present invention substantially departs from the conventional concepts and designs of the prior art, and in doing so provides an apparatus primarily developed for the purpose of lifting vehicles to obviate the possibility of slippage while being serviced to thereby increase safety.

Therefore, it can be appreciated that there exists a continuing need for a new and improved safety vehicle lift which can be used for lifting vehicles to obviate the possibility of slippage while being serviced to thereby increase safety. In this regard, the present invention substantially fulfills this need.

SUMMARY OF THE INVENTION

In view of the foregoing disadvantages inherent in the known types of jacks and hoists for cars, trucks and other vehicles now present in the prior art, the present invention provides a new and improved safety vehicle lift. As such, the general purpose of the present invention, which will be described subsequently in greater detail, is to provide a new and improved safety vehicle lift and methods which have all the advantages of the prior art and none of the disadvantages.

To attain this, the present invention essentially comprises a new and improved safety vehicle lift comprising, in combination, a unitary base of a flat rigid construction having parallel side edges and having parallel front and rear edges; a lifting assembly comprising a lower portion secured to the base between the side edges and adjacent to the rear edge, the lifting assembly also including a support platform positionable above the lower platform with crossed-linkage elements coupling the support platform and the lower platform in a scissor-like configuration, the linkage elements having pivotable ends secured to the lower portion and the support platform adjacent to the rearward end and axially shiftable ends secured for parallel movement within the lower portion and the support platform; drive mechanisms operatively coupled to the linkage mechanisms, the drive mechanisms including a jack screw with a threaded exterior surface and a cross brace with a threaded interior aperture centrally thereof coupled to the jack screw for axial movement with respect thereto upon rotation of the jack screw, the cross member having opposite ends secured to the axially shiftable ends within the lower portion for linear movement thereof parallel with the lower portion to effect the raising and lowering of the support platform while maintaining its parallelism with the lower portion; and a ramp having a lower end at the front edge of the base and a raised end at an intermediate portion of the base between the front end and the rear end adjacent to the end of the support plate remote from the rear end of the base for allowing the wheel of a car to be driven up the ramp and onto the support platform when in the lower orientation, the support platform having upturned edges adjacent to its rearward and forward ends.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety vehicle lift which has all the advantages of the prior art jacks and hoists for cars, trucks and other vehicles and none of the disadvantages.

It is another object of the present invention to provide a new and improved safety vehicle lift which may be easily and efficiently manufactured and marketed.

It is a further object of the present invention to provide a new and improved safety vehicle lift which is of a durable and reliable construction.

An even further object of the present invention is to provide a new and improved safety vehicle lift which is susceptible of a low cost of manufacture with regard to both materials and labor, and which accordingly is then susceptible of low prices of sale to the consuming public, thereby making such a safety vehicle lift economically available to the buying public.

Still yet another object of the present invention is to provide a new and improved safety vehicle lift which provides in the apparatuses and methods of the prior art some of the advantages thereof, while simultaneously overcoming some of the disadvantages normally associated therewith.

Even still another object of the present invention is to lift vehicles to obviate the possibility of slippage while being serviced to thereby increase safety.

Lastly, it is an object of the present invention to provide a safety vehicle lift comprising a unitary base of a flat rigid construction having parallel side edges and having parallel front and rear edges; a lifting assembly comprising a lower portion secured to the base between the side edges and adjacent to the rear edge, the lifting assembly also including a support platform positionable above the lower platform with crossed-linkage elements coupling the support platform and the lower platform in a scissor-like configuration, the linkage elements having pivotable ends secured to the lower portion and the support platform adjacent to the rearward end and axially shiftable ends secured for parallel movement within the lower portion and the support platform; drive mechanisms operatively coupled to the linkage mechanisms to effect the raising and lowering of the support platform while maintaining its parallelism with the lower portion; and a ramp having a lower end at the front edge of the base and a raised end at an intermediate portion of the base between the front end and the rear end adjacent to the end of the support plate remote from the rear end of the base for allowing the wheel of a car to be driven up the ramp and onto the support platform when in the lower orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
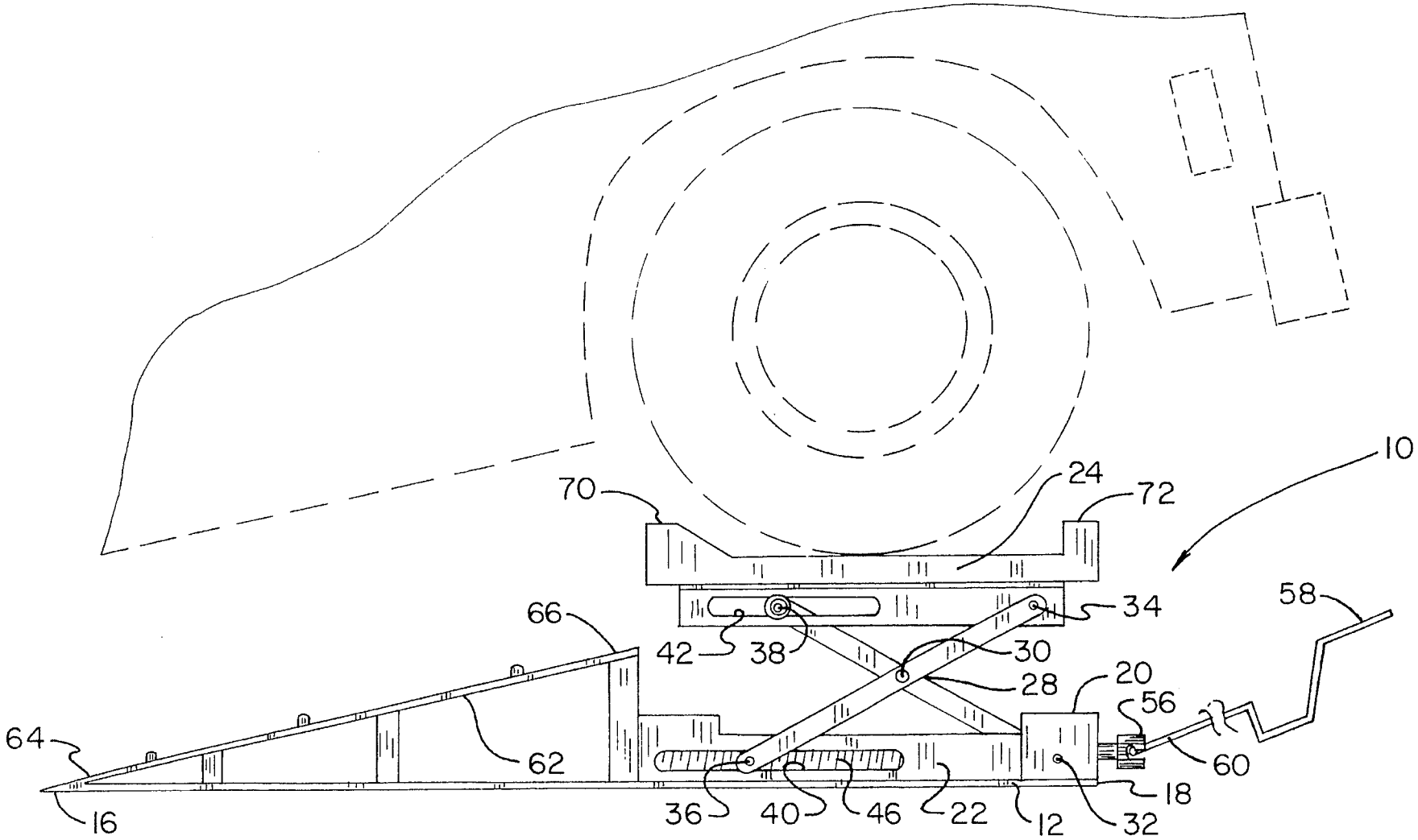
FIG. 1 is a side elevational view of the new and improved safety vehicle lift constructed in accordance with the principles of the present invention.
Figure 2:
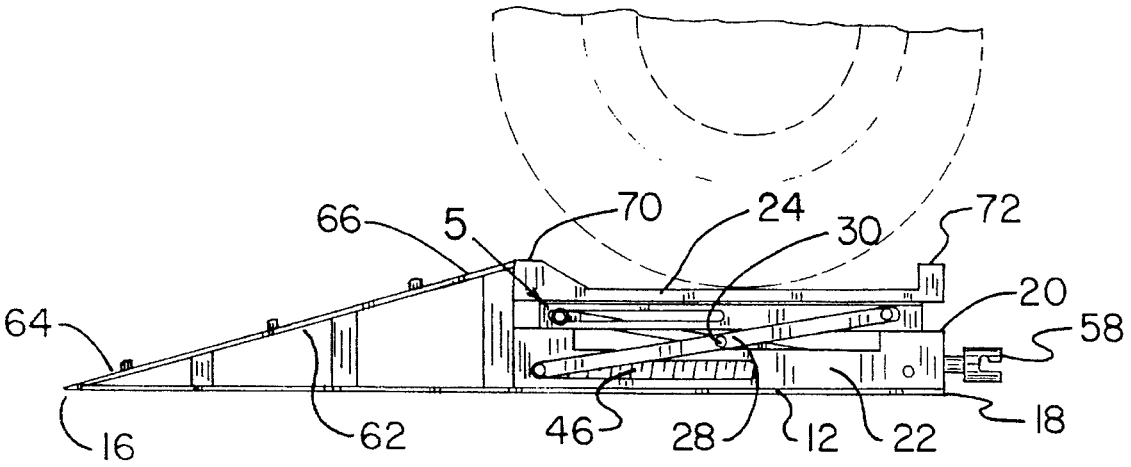
FIG. 2 is a side elevational view of the device shown in FIG. 1 but with the support platform in the lower orientation.
Figure 3:
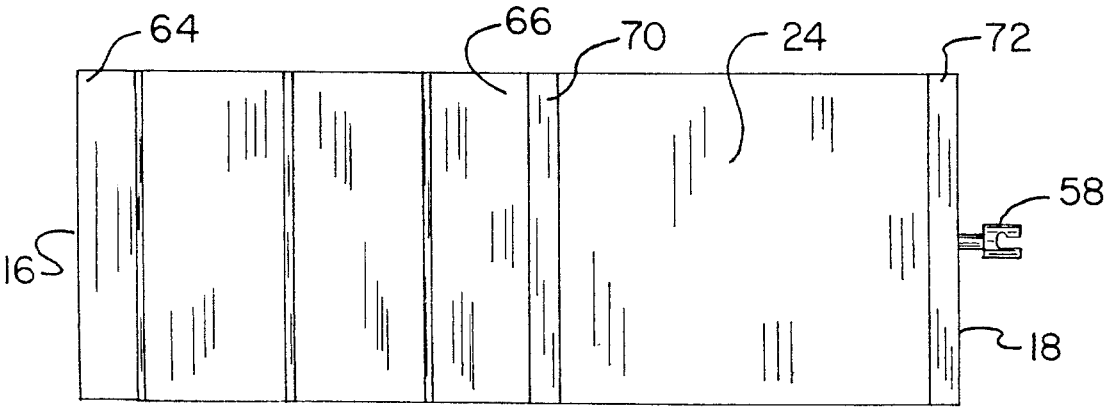
FIG. 3 is a top elevational view of the device shown in FIGS. 1 and 2.
Figure 4:
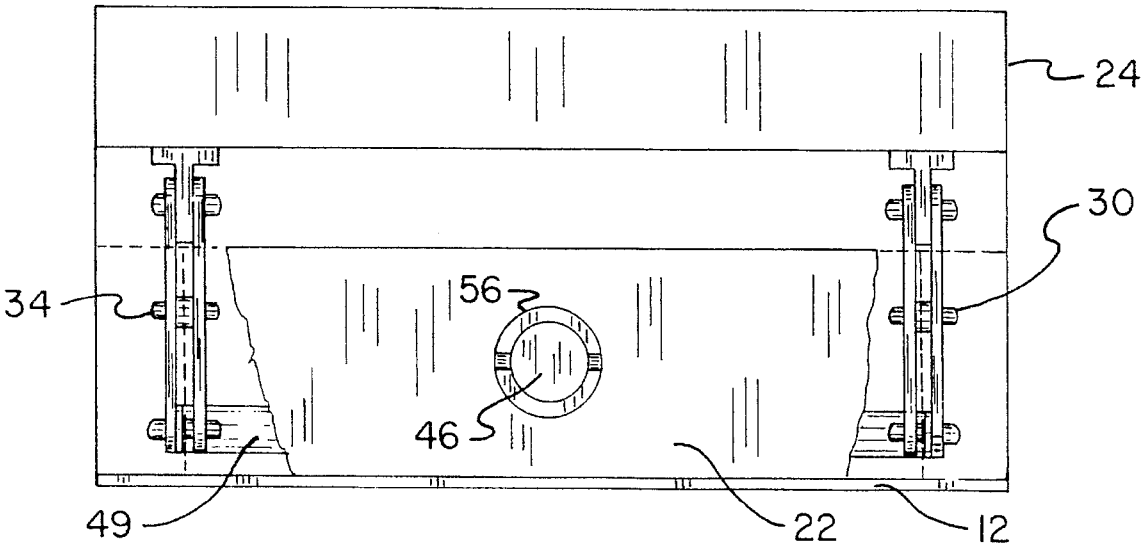
FIG. 4 is a rear elevational view of the device shown in FIGS. 1, 2 and 3 with parts removed to show certain constructions thereof
Figure 5:
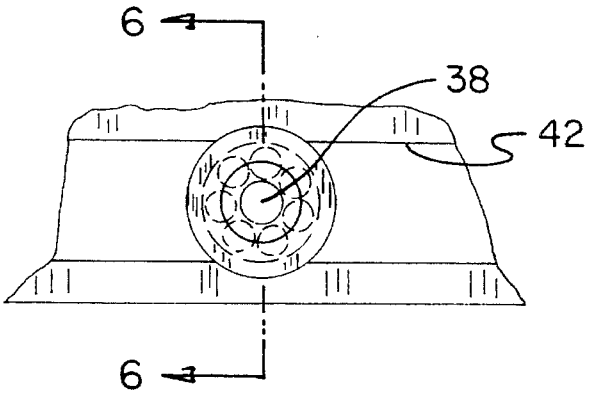
FIG. 5 is an enlarged view of the portion of the device shown in the prior Figures taken about circle 5 of FIG. 2.
Figure 6:
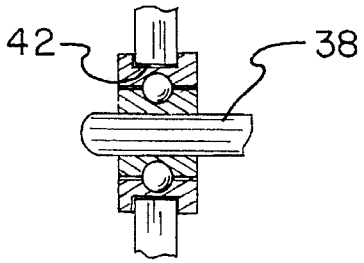
FIG. 6 is a cross-sectional view taken along line 6—6 of FIG. 5.
Figure 7:
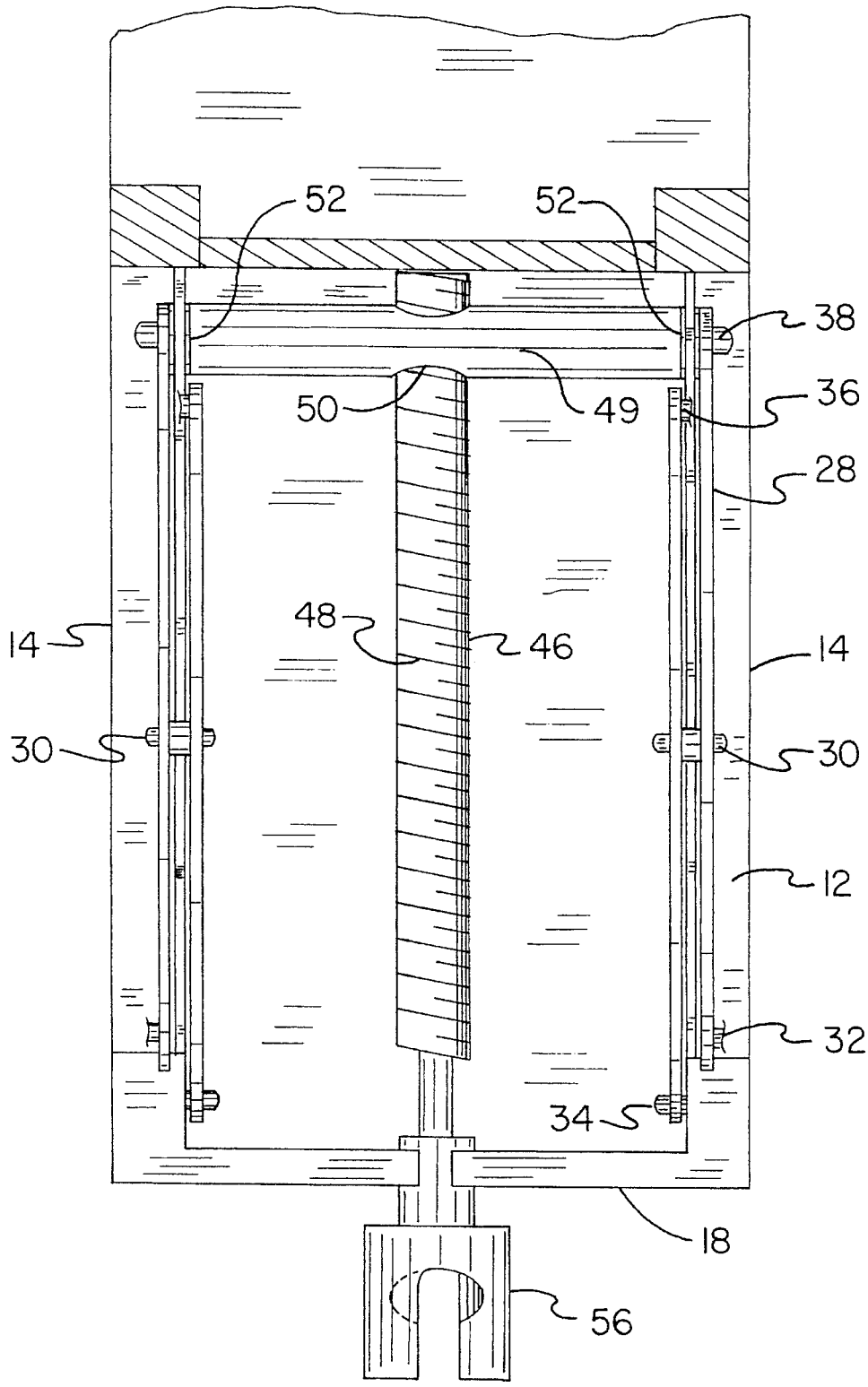
FIG. 7 is a top elevational view of a portion of the lifting components with the support platform removed.

With reference now to the drawings, and in particular to FIGS. 1 through 7 thereof, the preferred embodiment of the new and improved safety vehicle lift embodying the principles and concepts of the present invention and generally designated by the reference numeral 10 will be described.

The present invention, the new and improved safety vehicle lift is a system comprised of a plurality of components. The components in their broadest context include a base, lifting assembly, drive mechanisms and ramp. Each of the individual components is specifically configured and correlated one with respect to the other to attain the desired objectives.

More specifically, the system 10 of the present invention has as its underlying unit a unitary base 12. The base is of a flat rigid construction, preferably of a sheet metal for holding together the components thereabove. It is formed with parallel side edges 14. It also has a parallel front edge and rear edge 16, 18.

Physically secured with respect to the base is a lifting assembly 20. The lifting assembly is comprised of a lower portion 22. The lower surface of the lower portion is secured to the base plate between the side edges and adjacent to the rear edge. It extends forwardly to a midpoint of the base. The lifting assembly also includes a support platform 24. The support platform is positionable above the lower portion. It is of a similar length and width as the lower portion.

Secured with respect to the upper surface of the base and the lower surface of the support platform are crossed-linkage elements 28. Such linkage elements couple the support platform and the lower portion for relative movement therebetween as caused during the lifting of the support platform. The linkage elements are in a scissor-like configuration pivotally coupled adjacent to their midpoint 30. Similar linkage elements are located adjacent to each side edge of the base, lower portion and support platform. The linkage elements have pivotal ends 32, 34 secured to the lower portion and support platform adjacent to the rearward end above the base. The linkage elements also have axially shiftable ends 36, 38 secured in horizontally disposed recesses 40, 42 in the sides of the lower portion and support platform. Such an arrangement allows for the axially shiftable ends to effect parallel movement of the ends of the linkage elements within the lower portion and the support platform.

Next provided are drive mechanisms 46. The drive mechanisms are operatively coupled to the linkage mechanisms. The drive mechanisms include a horizontally oriented, centrally disposed jack screw between the lower portion and support platform. The jack screw has a threaded exterior surface 48 and a cross brace with a threaded interior aperture 50 centrally thereof. The cross brace is coupled to the jack screw through the threads for axial movement of the cross base upon rotation of the jack screw. The cross brace has opposite ends 52. Such opposite ends are secured to the axially shiftable ends of the linkage elements within the lower portion to effect their linear movement in a horizontal direction parallel with the lower platform. This motion is such as to effect the raising and lowering of the support platform while maintaining its parallelism with respect to the lower portion.

Rotation of the jack screw is effected through an operator-controlled handle 56. Such handle has an exterior end 58 for being grasped and manipulated by a user. It also has an interior end 60 coupled to the end of the jack screw over the rear end of the base to effect the desired movement of the support platform between a lower first inoperative orientation and a second raised operative orientation.

Lastly provided is a ramp 62. The ramp has a lower end 64 at the front edge of the base. It also has a raised end 66 at intermediate portion of the base. Such intermediate portion is about midway between the front end and rear end of the base. The raised end of the ramp is located adjacent to the end of the support plate remote from the rear end of the base. This relationship between ramp and support platform is such as to allow the wheel 68 of a car to be driven up the ramp and onto the support platform when the support platform is in the lower orientation.

The support platform is also provided with upturned edges 70, 72. Such edges are adjacent to the rearward end and the forward end of the support platform and add security to the system by precluding the wheel of a car on the support platform from rocking forwardly or rearwardly and leaving its support relationship between the wheel and support platform.

The present invention is designed to safely lift any vehicle and obviate the possibility of slippage while that vehicle is being serviced. It is made in three sections, namely, the base, the ramp and the support platform, each of which is eleven and one half inches in width. The base is three feet long and mounted on non-skid material at either end. The ramp is permanently mounted at one end of the base, is sixteen inches long and has a shallow incline relative to the base.

The support platform is also sixteen inches long, has raised edges along either end and is mounted adjacent to the ramp at an initial height of seven inches. This section is attached to the base with crossing scissor-like levers designed to be elevated to a height of ten to fifteen inches. This can be done using either the mechanical method, with a turning hand crank, or a hydraulically powered cylinder.

To use the present invention, one simply positions it directly in line with the appropriate tire, or tires, and drives up the shallow ramp. The raised edge at the end o the platform will serve to indicate that the vehicle is, in fact, on the platform. It is then a simple matter to block the wheels, raise the vehicle and install the provided safety locks. The vehicle will thus be positively positioned with no tendency to move backward, forward or to the side.

The alternatives are not attractive. It is difficult to properly position a conventional jack, and other stationary drive-up ramps make it difficult to align the vehicle and stop it in the proper position. The present invention addresses and eliminates these problems.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. The new and improved safety vehicle lift comprising, in combination:

a unitary base of a flat rigid construction having parallel side edges and having parallel front and rear edges;

a lifting assembly comprising a lower portion secured to the base between the side edges and adjacent to the rear edge, the lifting assembly also including a support platform positionable above the lower portion with crossed-linkage elements coupling the support platform and the lower portion in a scissor-like configuration, the lower portion and the support platform having a similar width of about 11½ inches and a length of about 16 inches, the lower portion and the support platform each having horizontally disposed recesses therein, the support platform having a rearward end with upturned edges adjacent thereto and a forward end with an upturned edge;

the crossed-linkage elements having pivotable ends, one of the pivotable ends being secured to the lower portion and another of the pivotable ends being secured to the support platform, each pivotable end further being adjacent to the rearward end of the base the linkage elements further having axially shiftable ends secured within a respective horizontally disposed recess for parallel movement within the lower portion and the support platform;

drive mechanisms operatively coupled to the linkage mechanisms, the drive mechanisms including a jack screw with a threaded exterior surface and a cross brace with a threaded interior aperture centrally thereof coupled to the jack screw for axial movement with respect thereto upon rotation of the jack screw, the cross member having opposite ends secured to the axially shiftable ends within the lower portion for linear movement thereof parallel with the lower portion to effect the raising and lowering of the support platform while maintaining its parallelism with the lower portion;

an operator-controlled handle having an interior end coupled to the jack screw to effect the desired movement of the support platform between a lower first inoperative orientation and a second raised operative orientation; and a ramp having a lower end at the front edge of the base and a raised end at an intermediate portion of the base between the front end and the rear end adjacent to the end of the support plate, the lower end and the raised end being integral with the base, the front edge having a shallow incline relative to the base and being remote from the rear end of the base for allowing a wheel of a car to be driven up the ramp and onto the support platform when in the lower orientation, the wheel being positioned onto the support platform when the support platform being in the raised orientation and being secured thereon with the upturned edges of the rearward and forward end, the upturned edges obviate the possibility of the wheel being positioned thereon from slipping off the support platform when raised in the second operative position.

* * * * *